US006049031A

United States Patent [19]

Caulkins

[11] Patent Number: 6,049,031

[45] Date of Patent: Apr. 11, 2000

[54] MAGNETIC VALVE SYSTEM FOR A MUSICAL INSTRUMENT

[76] Inventor: Kenneth B. Caulkins, 4218 Jessup Rd., Ceres, Calif. 95307

[21] Appl. No.: 08/932,380

[22] Filed: Sep. 17, 1997

[51] Int. Cl.[7] ..... G10D 9/04

[52] U.S. Cl. ..... 84/50; 84/59; 84/60; 84/155; 84/160; 84/645; 251/129.02; 137/247.13; 137/251.1

[58] Field of Search ..... 84/115, 146–147, 84/151, 155, 156, 160, 50–51, 59–60, 645; 137/247.13, 251.1, 391, 392, 487.5, 625.48, 625.65, 627.5; 251/129, 129.02, 129.09, 129.1, 139, 330

[56] References Cited

U.S. PATENT DOCUMENTS 4,312,380 1/1982 Leiber et al. ..... 137/627.5
4,336,737 6/1982 Pomber ..... 84/151
4,619,177 10/1986 Caulkins .
4,995,290 2/1991 Heischober et al. ..... 84/160
5,407,131 4/1995 Maley et al. ..... 239/90
5,441,434 8/1995 Caulkins .

*Primary Examiner*—Robert E. Nappi
*Assistant Examiner*—Marlon T. Fletcher
*Attorney, Agent, or Firm*—Miles & Stockbridge P.C.; William L. Feeney

[57] ABSTRACT

A magnetic valve uses neodymium magnets to maintain itself in a state, either closed or open. Upon applying electrical signals to a coil, the valve state is changed. In the open state fluid may readily flow through the valve, whereas the closed state uses one or more magnets to seal a valve member such that fluid flow is blocked. In the open state, the magnitude of the electrical signal can be varied to vary the effective size of the opening through which fluid may flow, thereby providing proportional control. Importantly, the valve is controllable by a computer using a MIDI card such that the valve is especially suitable for adapting a player piano to operate from a computer. Additionally, the valve may be used in a sprinkler system, a fire suppression system, or various other applications.

17 Claims, 4 Drawing Sheets

MAGNETIC VALVE SYSTEM FOR A MUSICAL INSTRUMENT

BACKGROUND OF THE INVENTION

The present invention relates to a magnetic valve. More specifically, it relates to a magnetic valve which uses a permanent magnet to hold the valve closed. Even more specifically, it relates to such a magnetic valve operable to control a player piano or other musical device using a pneumatic and the system using the valve in conjunction with a MIDI (musical instrument digital interface) card of a computer.

Player pianos have been used for some time now. The player pianos use a pneumatic actuator to strike a piano key when a hole is sensed in a paper tape. The paper tape has a series of holes corresponding to the notes of the piano which are to be played. One can change paper tapes in order to change songs. The use and operation of such a paper tape player piano is well known and described for example in the present inventor's prior Pat. No. 4,619,177 issued Oct. 28, 1986 and entitled MUSICAL INSTRUMENT PNEUMATIC ACTUATOR. That patent, which is hereby incorporated by reference, relates to an improved pneumatic actuator. The pneumatic, as it is often called, is a valve and bellows assembly responsive to the paper tape and operable to play a piano key or otherwise actuate a musical note on a different musical instrument.

Although paper tapes have been the traditional manner of selecting notes for a player piano (or otherwise controlling actuation of a drum, tambourine, xylophone, etc.), paper tapes are subject to a number of disadvantages. For example, the paper tape may break or tear. The mechanism used to feed the paper tape may malfunction.

In recent years, various computers have had MIDI ( ) cards inserted in them. The MIDI cards serve as an interface between a MIDI file stored in the computer and a musical instrument operable under computer control. The musical instrument may, for example, be an electronic organ which sounds notes corresponding to the digitally stored data in the MIDI file being run. MIDI files can easily be created by amateur song writers and can be duplicated easily by simply copying a given MIDI file onto a computer disc or sending it as an attachment via e-mail. Thus, not only are the breakage and mechanism malfunction disadvantages of paper tape avoided, but the use of MIDI files gives much greater flexibility in automating the playing of a musical instrument.

Although MIDI files provide many advantages over paper tape, the pneumatically operated player pianos have a particular sound that listeners often enjoy. Also, player pianos, unlike a typical MIDI file run electronic organ, uses its program (i.e., song represent on the paper tape) to cause the deflection of the piano keys. In other words, the player piano keys actually move as the notes sound. This key movement is enjoyed by those who like player pianos.

Basically, one can obtain the sound and look of a player piano by putting up with the disadvantages of the paper tape. Alternately, one can avoid paper tapes by using MIDI files and associated equipment, but one loses the sound and look of a player piano.

In other fields of technology, outside of musical instruments, valves controlling fluid flow have been used for lawn sprinklers, fire suppression sprinklers, hydraulic operated systems, and numerous other purposes. The valves have been made in numerous different ways, but have often been subject to one or more of several disadvantages. The valves may require the application of power in order to close. Some valve designs require springs which are prone to changing their characteristics over time. Some valves are not compatible with computer control. Difficulties in maintaining a valve completely closed pose problems in certain applications. Providing proportional control whereby a valve can have many open positions with different fluid flow rates (i.e., for a given supply pressure) or even a continuous range of possible flow rates is difficult or impossible with some valves.

OBJECTS AND SUMMARY OF THE INVENTION

Accordingly, it is a primary object of the present invention to provide a new and improved magnetic valve.

A more specific object of the present invention is to provide a magnetic valve operable to control a player piano and similar pneumatically run musical instruments.

A further object of the present invention is to provide a valve responsive to a MIDI file on a computer and operable to control a player piano and similar pneumatically run musical instruments.

Yet another object of the present invention is to provide a valve that is computer interfaceable and that provides proportional control.

A further object of the present invention is to provide a valve capable of automatically shutting off when no power is available.

Yet another object of the present invention is to provide a new and improved fluid valve.

Yet another object of the present invention is to provide a fluid valve operable as a motor valve with no springs required.

Yet another object of the present invention is to provide a valve operable as a regulator to regulate fluid pressure.

The above and other features of the present invention which will be more readily understood when the following detailed description is considered in conjunction with the accompanying drawings are realized by a system including a valve. The valve has: a housing with an inlet port and an outlet port; a valve member movably disposed in the housing; a coil responsive to electrical signals to change the valve between a closed state in which the valve member completely blocks fluid flow between the inlet port and the outlet port and an open state with the valve member moved to allow fluid flow between the inlet port and the outlet port; and at least a first magnet in the housing and operable to maintain the valve in one of the states unless an activating electrical signal is applied to the coil.

Preferably, the first magnet is a neodymium magnet. The first magnet maintains the valve in a closed state. A pneumatic is operably connected to the valve such that operation of the valve controls the pneumatic.

The system further includes a plurality of like constructed valves, each operably connected to a corresponding one of a plurality of pneumatics, each pneumatic operably connected to sound a musical instrument. The musical instrument is a player piano.

A computer is operably connected to the valve. The computer is operably connected to the valve by way of a MIDI card.

In an alternate embodiment, the valve is connected to a water pressure source and is operable to control water flow. The control is a water sprinkler controller or alternately a fire sensing control. The control is operably connected to control the valve. The valve opens variable amounts depending on the magnitude of the electrical signal applied to the coil.

The present invention may alternately be described as a system including a actuator with an actuator member movable between an activated state and a rest state. The actuator may specifically may be a valve having: a housing with an inlet port and an outlet port; a valve member movably disposed in the housing; a coil responsive to electrical signals to change the valve between a closed state in which the valve member completely blocks fluid flow between the inlet port and the outlet port and an open state with the valve member moved to allow fluid flow between the inlet port and the outlet port; and at least a first magnet in the housing and operable to maintain the valve in the closed state unless an activating electrical signal is applied to the coil. The valve is operable to control fluid flow to a pneumatic.

A computer is operably connected to the valve and operable to control the valve based on a computer data file representing music. The computer is operably connected to the valve by way of a MIDI card. The system further includes a pneumatic. The pneumatic is operably connected to the valve such that operation of the valve controls the pneumatic. The system has a musical instrument and the pneumatic is operably connected to sound the musical instrument. The musical instrument is a player piano.

A second magnet is disposed in the housing. The second magnet is attached to the valve member. The first and second magnets repel each other so as to normally maintain the valve closed. The coil repels the second magnet when the coil is energized such that the second magnet moves toward the first magnet and moves the valve member to an open position. The valve opens variable amounts depending on the magnitude of the electrical signal applied to the coil such that the valve controls the loudness of sound from the musical instrument.

The system further includes a plurality of like constructed valves, each operably connected to a corresponding one of a plurality of pneumatics, each pneumatic operably connected to sound a musical instrument.

BRIEF DESCRIPTION OF THE DRAWINGS

The above and other features of the present invention will be more readily understood when the following detailed description is considered in conjunction with the accompanying drawings wherein like characters represent like parts throughout the several views and in which:

FIG. 3 is a side view of a disc member;

FIG. 4 is a top view of the member of FIG. 3;

FIG. 5 is a bottom view of a housing member;

FIG. 6 is a side view of the member of FIG. 5;

FIG. 7 is a top view of a end cap member;

FIG. 8 is a side view of the member of FIG. 7;

FIG. 9 is a side view of a magnet holding member;

FIG. 10 is a top view of the member of FIG. 9;

FIG. 11 is a side view of a valve member;

FIG. 12 is a top view of the member of FIG. 11;

DETAILED DESCRIPTION

Figure 1:
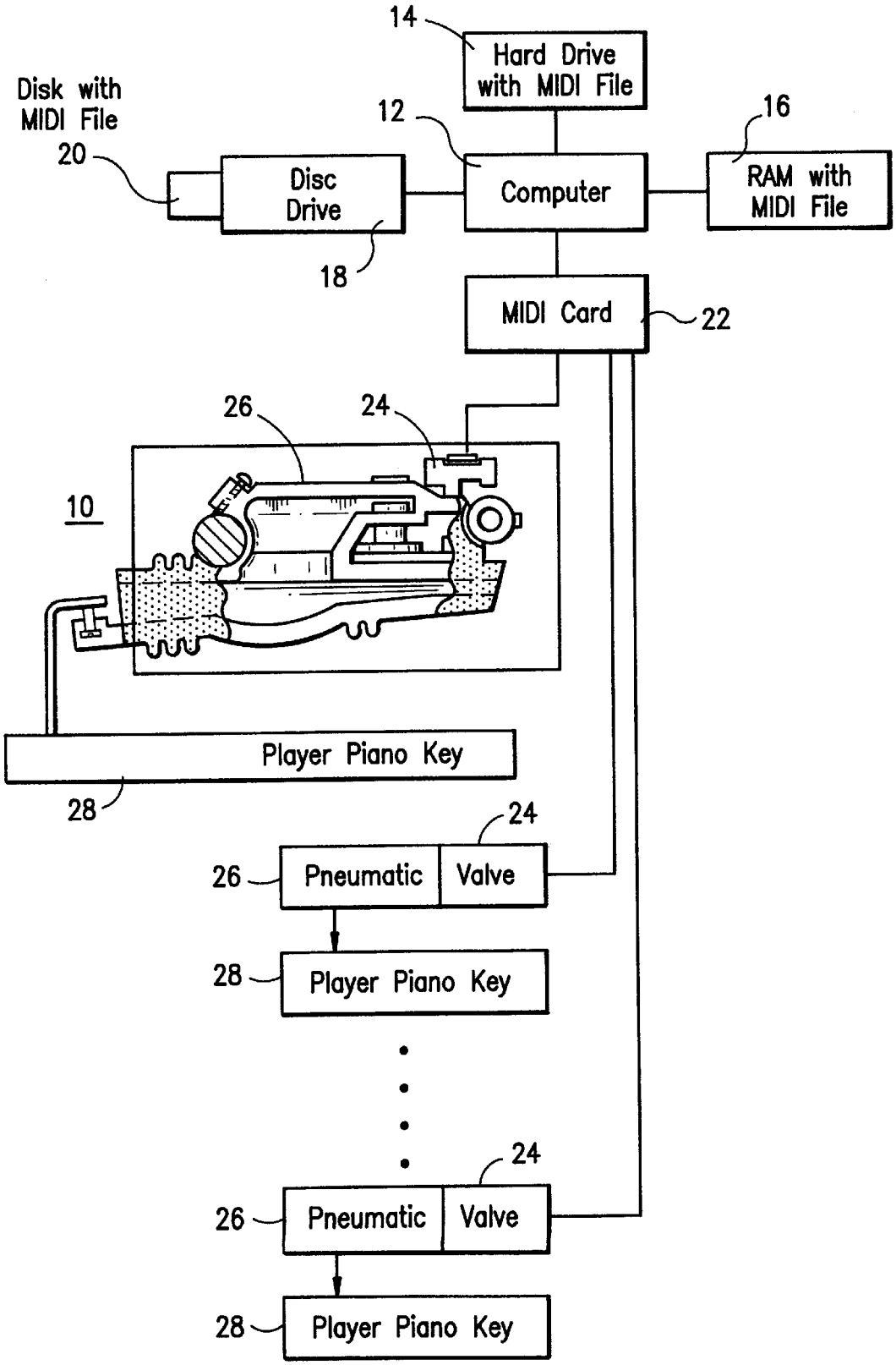
FIG. 1 is a simplified block diagram of the present invention combined with side view with some portions broken away.

FIG. 1 shows a simplified block diagram of a computer player piano system 10 according to the present invention. A computer 12 has a hard drive memory 14, RAM or read/write memory 16, and disc drive 18. MIDI (musical instrument digital interface) files may be stored in hard drive 14, memory 16, and/or a floppy disc 20 inserted into disc drive 18. A MIDI card (i.e., the actual musical instrument digital interface) 22 is run by the computer in known fashion.

Electrical control lines extend to each of numerous valves 24, only three of which are shown, two illustrated in block form and one in side view. Each valve 24 is electrically controlled to actuate a corresponding pneumatic 26, which in turn controls a corresponding player piano key 28. The interaction between the pneumatics 26 and piano keys 28 is the same as that discussed in the present inventor's incorporated by reference patent and need not be discussed in detail here. Briefly, the pneumatic may be changed between two states in order to lift one end of the corresponding key and, by fulcrum action, depress the other end of the key.

In the incorporated by reference patent the pneumatics are operated by tubes going to the paper tape. When a tube senses a hole in the paper tape, air flows into that tube and operates the corresponding pneumatic. However, the electrically operated valves 24 are used in the present system such that MIDI files can supply the information necessary to play music on the player piano. The operation of the valve 24, which serves to interface a computer (via the MIDI card) with a pneumatic will now be discussed.

Figure 2:
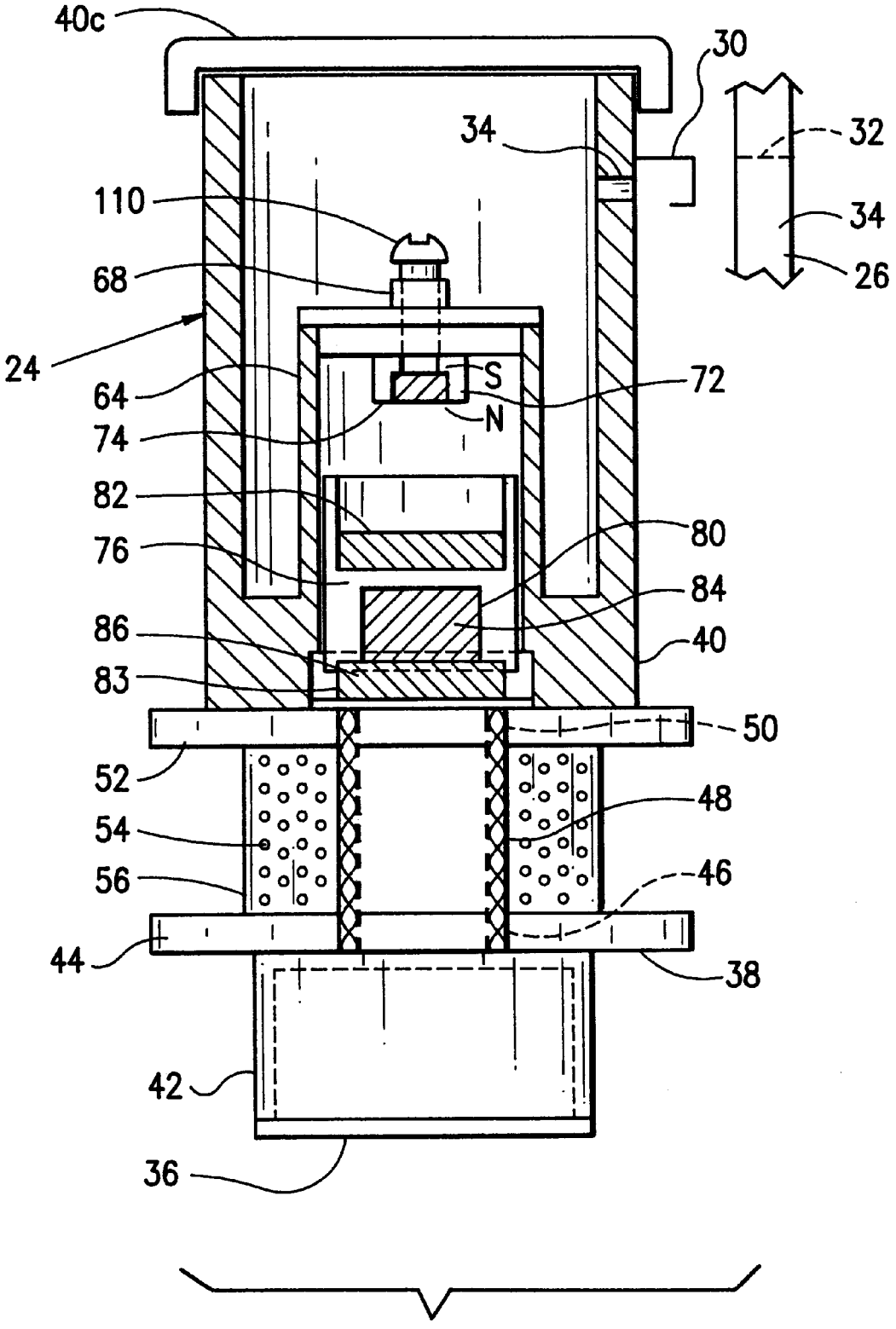
FIG. 2 is a side view with portions in cross section of a valve according to the present invention.
Figure 3:
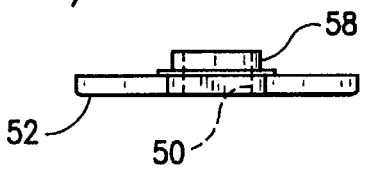
FIGS. 3–12 are views of various parts of the valve, specifically.
Figure 4:
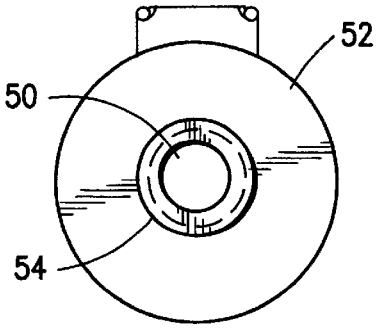
Figure 5:
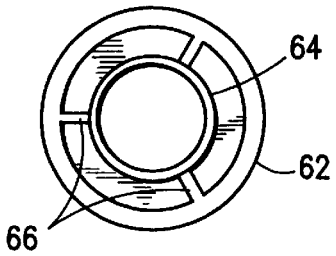
Figure 6:
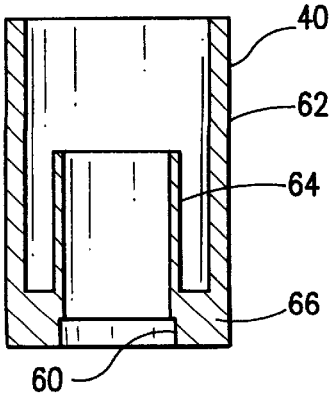
Figure 7:
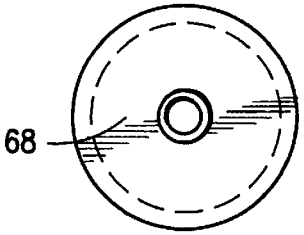
Figure 8:
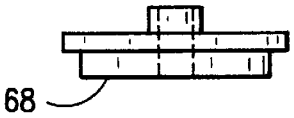
Figure 9:
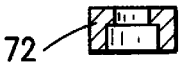
Figure 10:
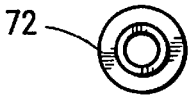
Figure 11:
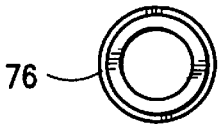
Figure 12:
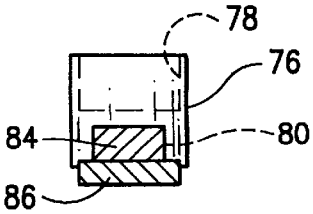

The valve 24 has a mount tube 30 which fits into a matching hole 32 on the top member 34 of pneumatic 26 (only a few parts of which are shown in FIG. 2). The mount tube 30 is hollow and serves as an outlet port 34 for air entering an inlet port 36 having optional felt or fabric cover 38 to prevent dirt from entering with the air. Before presenting details of the valve operation, the overall operation will be explained. The valve 24 is may be changed from a closed state in which air flow from port 36 to port 34 is blocking to an open state in which air may flow from port 36 to port 34. The air flow is drawn through the valve by the suction at port 34 via hole 32 and a suction pump, not shown, operably connected to the pneumatic 26 in known fashion. Thus, the pneumatic 26 is operated by valve 24. Instead of using a paper tape, the valve 24 operates the pneumatic under control of a data file representing music (such as a MIDI file) on computer 12 (FIG. 1 only). The pneumatic in turn operates the player piano.

The valve housing includes a inlet end piece 38 and an outlet end piece 40 (with cover 40C closing off one end thereof). The inlet end piece 38 has a hollow cylindrical portion 42 with a disc 44 partially closing one end, but having hole 46 therein. A hollow steel core 48 (hollow to allow air flow therethrough) has one end fixed into hole 46 and another end fixed in hole 50 of a disc member 52. Surrounding the iron core 48 is a coil 54 having a plurality of insulated wire turns. A plastic or tape cover 56 surrounds the coil 54.

Continuing to view FIG. 2, but also considering FIGS. 3–12, numerous other components of the valve 24 will be discussed. The disc member 52 has hole 50 with extension cylindrical portion 58 which seats in a hole 60 in piece 40. Piece 40 has an outer cylinder 62, an inner cylinder 64, and ribs 66 connecting them. The inner cylinder 64 has an end cap 68 with a travel adjustment screw 70 (FIG. 2 only) having magnet holder 72 holding neodymium magnet 74 thereon. By using the screw 70 to adjust magnet 74 up or down, the total travel of a valve member 76 may be varied.

The valve member 76 has first and second cylindrical hollow portions 78 and 80. Portion 78 seats a rubber stop 82 (FIG. 2 only) which abuts holder 72 and magnet 74 when the valve member 76 is at the top of its travel, not shown. Portion 80 has neodymium magnet 84 and rubber disc 86 mounted therein. The rubber disc 86 seals the valve member 76 against a rubber (or other resilient material such as kraton) washer 88 (FIG. 2 only) when the valve member 76 is at the bottom of its travel as shown in FIG. 2.

The FIG. 2 position for the valve member corresponds to the valve being closed with valve member 76 blocking fluid flow from inlet port 36 to outlet port 34. The FIG. 2 closed state is the normal (i.e., no power applied) state for the valve 24 as the magnet 84 is attracted to the iron core 48. Additionally, the upper pole of the magnet 84 would be north in order to repel the downward facing north pole of magnet 74. (Alternately, the facing poles of the two magnets could both be south.) The repulsion of the magnets and the attraction of magnet 84 to core 48 holds the valve tightly sealed in the FIG. 2 position.

When an actuating electrical signal is applied to the copper coil 54, the coil establishes a magnetic field having a south pole at its upper end. The electrically induced magnetic south pole repels the lower south pole of magnet 84 and forces the valve member 76 upward by an amount dependent on the magnitude of the applied signal. This repulsion overcomes the repulsion of the two magnets 74 and 84 as valve member 76 may be moved as high as an upper limit of travel dependent on adjustments to screw 70. When valve member 76 moves up, the disc 86 and washer 88 are separated such that air may flow from inlet port 36 to outlet port 30 via the radial spaces between ribs 66 (see FIG. 5 for the ribs). Significantly, the valve automatically closes or shuts off when power is removed.

Figures 13, 14, 15:
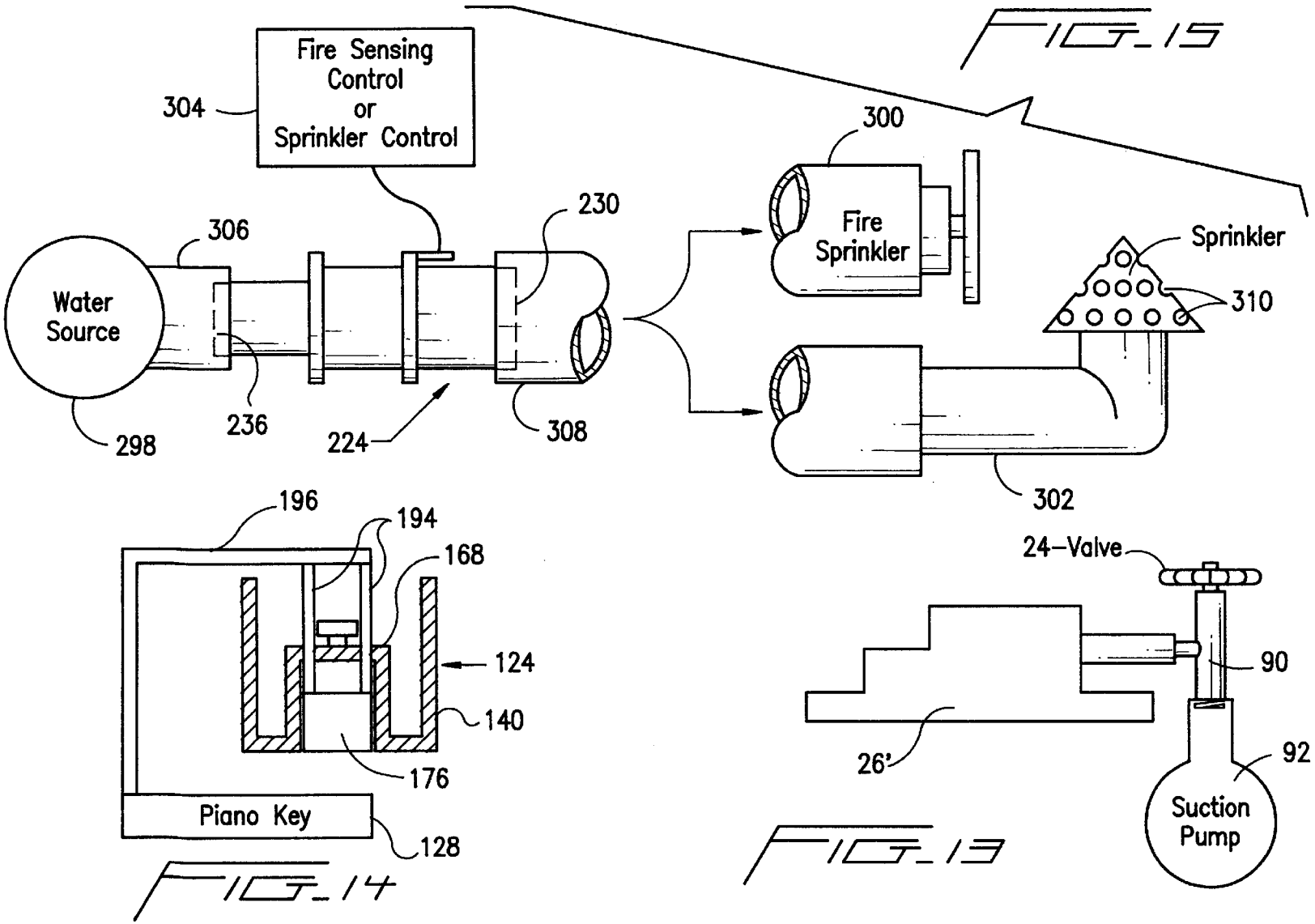
FIG. 13 shows the valve mounted on a different style of pneumatic.
FIG. 14 shows a side view illustrating the valve used for water control.

FIG. 13 shows how a pneumatic 26' which doesn't have the hole 32 (FIG. 2) for valve 24 may be operated with valve 24 by using a T shaped hollow connector 90. When valve 24 is closed, a suction pump 92 maintains a vacuum in a portion of pneumatic 26'. When valve 24 is opened under MIDI computer control, the vacuum is broken and the pneumatic is actuated, thus playing any piano key or other musical instrument operated by it.

FIG. 14 shows a side view, with parts in cross section, of an alternate design musical instrument actuator 124 according to the present invention. The components of FIG. 14 are labeled in the 100 series with the same last two digits as the corresponding component, if any, as in the structures of FIGS. 1–12. For ease of illustration, only a portion of actuator 124 is shown as the remainder is constructed identical to valve 24 except as discussed. The actuator 124 is not used as a valve, but member 176 is moved back and forth using magnets and a coil as discussed for valve 24. Member 176 differs from member 76 in that member 176 has extension bars 194 slidably extending through holes in cap 168. When member 176 is moved up by the magnetic operations discussed above for valve 24, the extension bars 194 displace connecting bar 196 and play piano key 128 or otherwise sound a musical instrument. In that fashion, the magnetic actuator 124 may sound a musical instrument without acting through a pneumatic. In the same fashion as with the valve 24, the magnitude of an electrical signal applied to two terminals of the coil, not shown, of actuator 124 controls the loudness of the sound produced.

FIG. 15 shows how a valve 224, constructed identically to valve 24 except as discussed below, may be used to control water flow from a source 298 to either a fire suppression sprinkler 300 or a lawn sprinkler 302 depending on electrical signals supplied by a control 304. The valve 224 has a supply or inlet end 234 having a hose or pipe 306 connected thereto and an outlet end 230 (i.e., no end cap such as 40C and no mount tube such as 30 thereon) connected to hose or pipe 308.

In the case of a fire sprinkler, the magnets such as 74 and 84 (FIG. 2 only) would be arranged such that they normally attract with opposite poles facing each other. Power would be applied to the coil to maintain the valve closed, the polarity of the coil causing it to normally attract the valve member. When the control 304 senses a fire, the power to the coil is cut off and the permanent magnets attract, thereby opening the valve and allowing water to flow out of one or more fire sprinklers 300. If the fire cuts off power, the valve stays open such that water continues to flow. Absent an indication of fire, a back up power system, not shown, would be used to avoid having a routine power outage cause the fire sprinklers to actuate.

In the case of a lawn or garden sprinkler such as 302, the valve 224 would operate with the same polarity arrangements as discussed for valve 24. Thus, power outage would stop all water flow. Importantly, the valve 224 has an anti-siphon action so as to naturally block water flow from hose 308 to hose 306, such anti-siphon action often being required for irrigation purposes or in many other water applications. When control 304 is a sprinkler control, it may have a timer and also may send a variable magnitude electrical signal to valve 224. The signal may vary the flow of water out of a sprinkler having a simple conical arrangement of spray holes 310 as shown. Thus, a very simple spray head can deliver a water pattern by varying the electrical signal from control 304.

Referring back to FIG. 2, the valve 24 may be used as a regulator to insure that pressure at inlet port 36 never exceeds an adjustable maximum. This can be done in various ways with the attraction and repulsion forces of coil 54 and magnets 74 and 84. With the polarity arrangement discussed above relative to FIG. 2, the repulsion of magnets 84 and 74 will keep the valve closed until the pressure at 36 overcomes the repulsion force of the magnets. If an electrical signal is applied to coil 54 to repel valve member 76, but without sufficient repulsion to open the valve, the valve will open at a lower pressure at 36.

The valve is a motor valve with no springs attached.

Some features of the preferred design include the following:

1. The 120 ohm 12 volt coil lends itself readily to MIDI outputs. Most being low wattage.
2. The coil bobbin has a cupped side for the attachment of a felt air filter. This significantly increases the air flow over a filter attached directly to the port.
3. The magnet chamber is tapered to allow the magnet to tip and self align. This is necessary to insure a good seal.
4. The coil core is hollow iron allowing the air to flow through. When no current is applied to the coil, the valve is closed. Thus, it is normally closed.
5. The actual valve is a cylindrical magnet. This is made possible through the use of neodymium ferrous boron compounds, resulting in a magnet nearly 400 times the pull of gravity.

6. The valve seats are Kraton synthetic rubber. This material is injection moldable allowing ease of manufacture. It makes the valve quiet and nearly air tight.
7. The magnet chamber is capped and the cap is easily removable for service.
8. The magnet chamber cap is hard plastic (ABS) with a Kraton valve seat or bumper in this case for quiet operation. We plan on making this cap of Kraton and eliminating the need for a bumper to be inserted.
9. The wrap post boss has a recession and a groove molded in it to protect the fine 0.004 wire from accidentally being broken.
10. The core of the coil can be slid in and out for various voltage requirements. If less voltage is available than 12 volts, the coil can be slid out until 5 volts will push the magnet away.
11. This valve works on the repulsion principal. When current is applied to the coil, the magnet is repelled from its seat. This is extremely important. It is always closed when off.
12. Standing bosses for the wrap posts allow heat dissipation while being soldered. This allows us to use a cheaper grade of plastic that would normally melt.
13. The bobbin end that is square is keyed to allow attachment 180 degrees from the perpendicular air port or right over the air port. This allows freedom to change the wrap post position in reference to the mounting of the valve.
14. The perpendicular nipple attaches to our existing pneumatic as shown in the sample provided.
15. The perpendicular nipple also attaches to the "T" as shown in the sample provided. This allows insertion as an in line or end of the line valve.
16. The plastic ring molded into the coil core chamber provides an effective stop to keep the core from going too far in when inserted. It also provides a stop for the correct insertion point to establish a 12 volt working condition.
17. The plastic ring molded into the coil core chamber provides an effective valve seat threshold for the rubber valve seat. This ring is designed to hold the valve seat at the proper height to insure that the magnet comes within a specified distance of the iron core when fully inserted. This specified distance allows proper operation at 12 volts. It could be adjusted in the mold for other voltages.
18. Other sizes will work for larger and smaller applications.
19. Readily available wrap post terminals with little gold plated fingers to hold wire without soldering are used.
20. Readily available roll pins are used for the hollow iron core.
21. These will work for other applications as well as MIDI.

If desired, the electric signal applied to the valves could be varied in frequency, pulse width, and/or duty cycle in order to vary the air pressure of the valve.

Although specific constructions have been presented herein, it is to be understood that these are for illustrative purposes only. Various modifications and adaptations will be apparent to those of skill in the art. In view of possible modifications, it will be appreciated that the scope of the present invention should be determined by reference to the claims appended hereto.

What is claimed is:

1. A system comprising a valve having a housing with an inlet port and an outlet port; a valve member movably disposed in the housing; a coil responsive to electrical signals to change the valve between a closed state in which the valve member completely blocks fluid flow between the inlet port and the outlet port and an open state with the valve member moved to allow fluid flow between the inlet port and the outlet port; at least a first magnet in the housing and operable to maintain the valve in one of the states unless an activating electrical signal is applied to the coil, and wherein the first magnet is a permanent magnet, wherein the valve opens variable amounts depending on the magnitude of the electrical signal applied to the coil; and further comprising a pneumatic and wherein the pneumatic is operably connected to the valve such that operation of the valve controls the pneumatic; the pneumatic being operatively connected to sound a musical instrument; and further comprising a musical instrument and wherein the actuator is operable to sound the musical instrument at variable volumes depending on the magnitude of the electrical signal applied to the coil.

2. The system of claim 1 wherein the first magnet is a neodymium magnet.

3. The system of claim 1 wherein the first magnet maintains the valve in a closed state.

4. The system of claim 3 further comprising a plurality of like constructed valves, each operably connected to a corresponding one of a plurality of pneumatics, each pneumatic operably connected to sound a musical instrument.

5. The system of claim 4 wherein the musical instrument is a player piano.

6. The system of claim 5 further comprising a computer operably connected to the valve.

7. The system of claim 1 further comprising a computer operably connected to the valve.

8. The system of claim 7 wherein the computer is operably connected to the valve by way of a MIDI card.

9. A system comprising an actuator having a housing; an actuator member movably disposed in the housing; a coil responsive to electrical signals to change the actuator between an activated state and a rest state; at least a first magnet in the housing and operable to maintain the actuator in the rest state unless an activating electrical signal is applied to the coil; and a musical instrument; and wherein the actuator is operable to sound the musical instruments and wherein the actuator moves variable amounts depending on the magnitude of the electrical signal applied to the coil; and wherein the housing has an inlet port and an outlet port; the actuator member is a valve member movably disposed in the housing; the coil is responsive to electrical signals to change the valve between a closed state in which the valve member completely blocks fluid flow between the inlet port and the outlet port and an open state with the valve member moved to allow fluid flow between the inlet port and the outlet port; the first magnet is operable to maintain the valve in the closed state unless an activating electrical signal is applied to the coil; and wherein the valve is operable to control fluid flow to a pneumatic and wherein the actuator is operable to sound the musical instrument at variable volumes depending on the magnitude of the electrical signal applied to the coil.

10. The system of claim 9 further comprising a computer operably connected to the valve and operable to control the valve based on a computer data file representing music.

11. The system of claim 9 further comprising a pneumatic and wherein the pneumatic is operably connected to the valve such that operation of the valve controls the pneumatic, and further comprising a musical instrument, and wherein the pneumatic is operably connected to sound the musical instrument.

12. The system of claim 11 wherein the musical instrument is a player piano.

13. A system comprising an actuator having a housing; a actuator member movably disposed in the housing; a coil responsive to electrical signals to change the actuator between a activated state and a rest state; at least a first magnet in the housing and operable to maintain the actuator in the rest state unless an activating electrical signal is applied to the coil; and a musical instrument; and wherein the actuator is operable to sound the musical instrument; and wherein the housing has an inlet port and an outlet port; the actuator member is a valve member movably disposed in the housing; the coil is responsive to electrical signals to change the valve between a closed state in which the valve member completely blocks fluid flow between the inlet port and the outlet port and an open state with the valve member moved to allow fluid flow between the inlet port and the outlet port; the first magnet is operable to maintain the valve in the closed state unless an activating electrical signal is applied to the coil; and wherein the valve is operable to control fluid flow to a pneumatic further comprising a pneumatic; and wherein the pneumatic is operably connected to the valve such that operation of the valve controls the pneumatic, and further comprising a musical instrument, and wherein the pneumatic is operably connected to sound the musical instrument wherein the musical instrument is a player piano; and further comprising a second magnet disposed in the housing, the second magnet attached to the valve member, the first and second magnets repelling each other so as to normally maintain the valve closed, and wherein the coil repels the second magnet when the coil is energized such that the second magnet moves toward the first magnet and moves the valve member to an open position.

14. The system of claim 13 wherein the valve opens variable amounts depending on the magnitude of the electrical signal applied to the coil such that the valve controls the loudness of sound from the musical instrument.

15. The system of claim 14 further comprising a plurality of like constructed valves, each operably connected to a corresponding one of a plurality of pneumatics, each pneumatic operably connected to sound a musical instrument.

16. The system of claim 11 further comprising a plurality of like constructed valves, each operably connected to a corresponding one of a plurality of pneumatics, each pneumatic operably connected to sound a musical instrument.

17. The system of claim 12 further comprising a plurality of like constructed valves, each operably connected to a corresponding one of a plurality of pneumatics, each pneumatic operably connected to sound a musical instrument.

* * * * *